US006945401B2

(12) United States Patent
Jopling

(10) Patent No.: US 6,945,401 B2
(45) Date of Patent: Sep. 20, 2005

(54) EMERGENCY STORAGE CONTAINER FOR GLUCOSE TABLETS

(76) Inventor: James Jopling, 705 Tarver St., Monroe, LA (US) 71201

( * ) Notice: Subject to any disclaimer, the term of this patent is extended or adjusted under 35 U.S.C. 154(b) by 0 days.

(21) Appl. No.: 10/619,618

(22) Filed: Jul. 16, 2003

(65) Prior Publication Data

US 2004/0035741 A1 Feb. 26, 2004

Related U.S. Application Data

(60) Provisional application No. 60/404,778, filed on Aug. 21, 2002.

(51) Int. Cl.[7] ..... B65D 85/04

(52) U.S. Cl. ..... 206/538; 220/524; 206/37

(58) Field of Search ..... 206/528, 529, 206/530, 534, 534.1, 538, 539, 540, 37, 38, 38.1, 37.1, 37.4, 39; 220/524, 255, 526, 819; D3/201, 203.1, 203.2, 203.3, 203.8, 207, 208, 212, 203.4

(56) References Cited

U.S. PATENT DOCUMENTS 395,515 A * 1/1889 Robertson ..... 206/37
917,894 A * 4/1909 Pusterla ..... 70/408
1,345,359 A * 7/1920 Goertz et al. ..... 132/294
4,253,572 A * 3/1981 Halbich ..... 206/538
4,412,616 A * 11/1983 Williams ..... 220/524
4,458,570 A * 7/1984 Morrison ..... 83/375
4,543,798 A * 10/1985 Page ..... 62/239
4,611,726 A * 9/1986 Skinnell ..... 220/23.83
5,011,018 A * 4/1991 Keffeler ..... 206/532
5,947,278 A * 9/1999 Sawhney et al. ..... 206/216

* cited by examiner

*Primary Examiner*—Shian T. Luong
(74) *Attorney, Agent, or Firm*—Jacobson Holman PLLC

(57) ABSTRACT

An emergency storage container for glucose tablets including portions to attach the same to an item always carried by most people such as a key holder. The container includes a housing forming a pair of spaced, tablet-receiving pockets and an interconnected cover having hingedly secured portions movable from an open position permitting access to the tablets and a closed position sealing the pockets. An apertured tab forming part of the housing is adapted to receive a beaded chain or the like to attach the container to a key holder.

1 Claim, 2 Drawing Sheets

EMERGENCY STORAGE CONTAINER FOR GLUCOSE TABLETS

This is a complete application claiming benefit of provisional application Ser. No. 60/404,778 filed Aug. 21, 2002.

BACKGROUND OF THE INVENTION

1. Field of the Invention

This invention relates to a storage container and relates, more particularly, to a storage container for glucose tablets to be attached to a key holder to ensure that such tablets are readily available to a diabetic in the event of a glucose deficiency.

2. Description of the Related Art

Diabetics often face the common problem of having to locate glucose on a rather urgent basis to overcome a glucose deficiency, or what is commonly referred to as "low blood sugar". As a result, almost every diabetic has faced an emergency need for sugar.

Accordingly, it is common for diabetics to carry wrapped candy in their pocket, or to have to find some "high sugar" content food or drink immediately. Often, however, a sudden glucose deficiency occurs when no source of glucose is readily available. For that reason, a carrier for glucose tablets or the like attachable to an item carried by almost every individual, such as a key holder, would be highly desirable.

SUMMARY OF THE INVENTION

A primary object of this invention is to provide a simple and inexpensive means to ensure that a diabetic has an immediate supply of glucose should the need arise.

A further object of this invention is to provide an inexpensive storage container that has a suitable attachment so that it can be placed on an item carried by almost every individual, such as a key holder.

Still another object of this invention is to provide an emergency storage container which has at least one pocket or section sized to receive the most common size of glucose tablets commercially available to diabetics.

Yet another object of this invention is to provide an emergency storage container for glucose tablets including a housing having a pair of storage pockets and an attachable cover with complementary, separately hinged, cover sections for the pockets and with a tab on the housing having an aperture for reception of a flexible chain or other portion of a key holder or a similar item commonly carried by every individual.

The invention will be better understood, and objects other than those suggested above will become apparent, when consideration is given to the following detailed description, which makes reference to the annexed drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
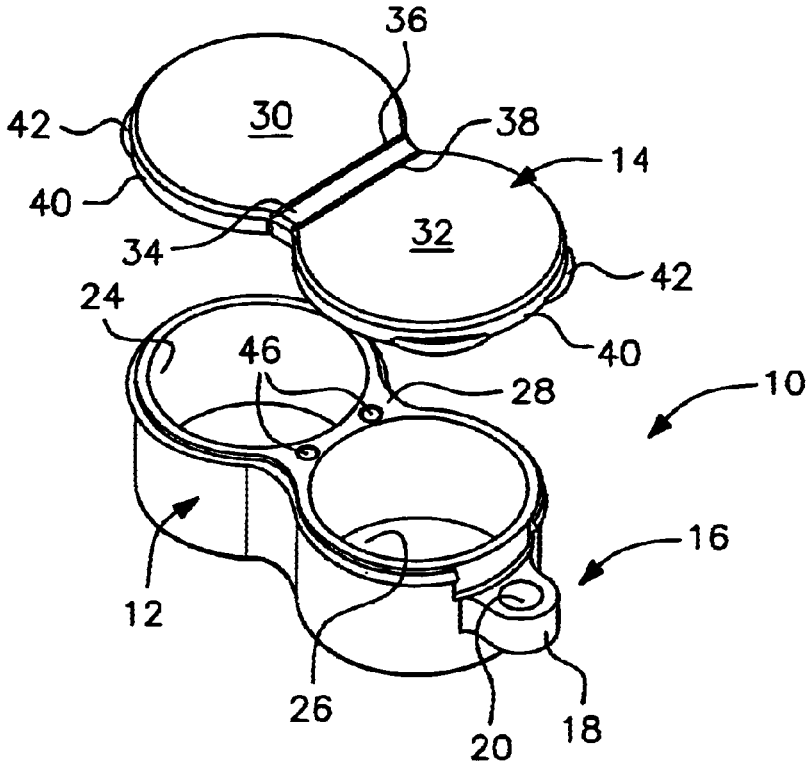
FIG. 1 is an exploded perspective view of one embodiment of a storage container according to a preferred embodiment of the instant invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
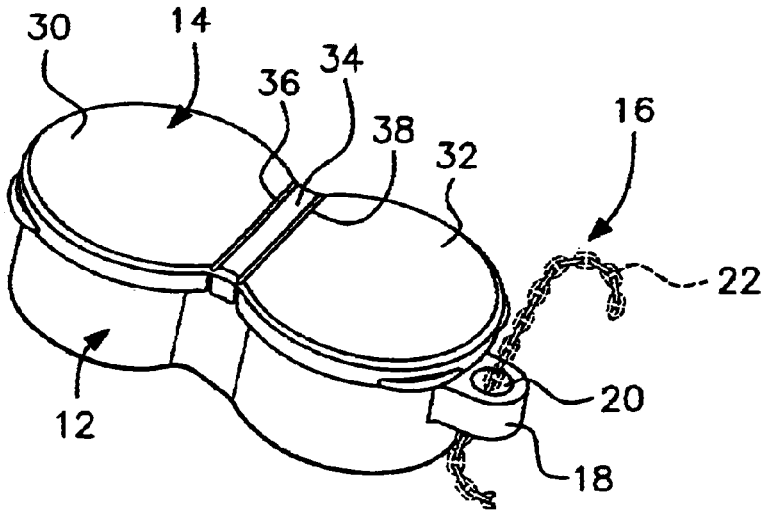
FIG. 2 is a perspective view of the storage container shown in FIG. 1 with the cover attached to the housing and in a closed position.
Figure 3:
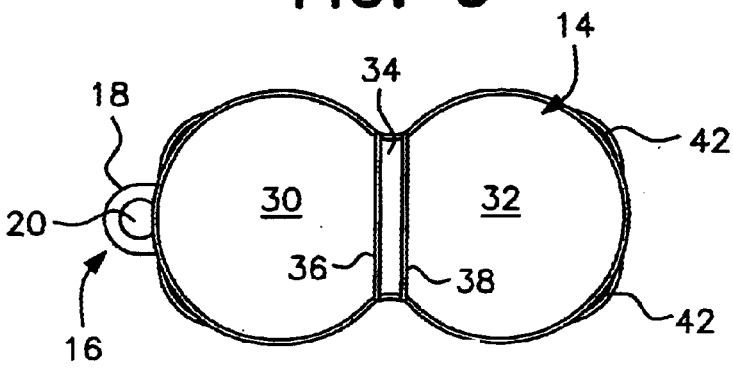
FIG. 3 is a top plan view of the storage container shown in FIG. 1.
Figure 4:
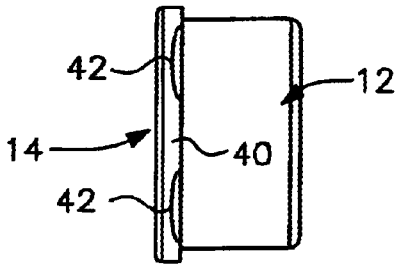
FIG. 4 is an end elevational view of the storage container shown in FIG. 1.
Figure 5:
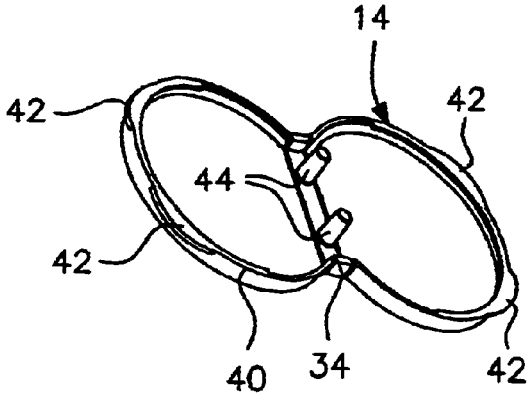
FIG. 5 is a bottom plan view of the cover for the housing of the storage container of FIG. 1.

Referring now to the drawings, a preferred embodiment of a storage container for glucose tablets is illustratively shown at 10 and comprising a housing 12, a cover 14, and means 16 to attach the storage container 10 to a key holder (not shown) or other such item. For purposes of illustration, the means 16 comprises a tab 18 forming part of the housing 12 and defining an aperture 20 for reception of a beaded chain or the like shown in dotted lines in FIG. 2 at 22 to be secured to a key holder in a well known manner.

The beaded chain 22 can be included as a part of the storage container 10 or may be part of the key holder. Alternatively, a solid element of the key holder, such as a ring or the like, may be inserted through the aperture 20 of the tab 18 in a similar manner.

The housing 12 and cover 14 are preferably made of a suitable plastics material such as polypropylene, although other materials may be readily substituted therefor by those with ordinary skill in this art without departing from the instant inventive concepts.

The housing 12 comprises portions defining at least one storage pocket dimensioned to receive at least one glucose tablet (not shown). In the preferred embodiment illustrated, the housing 12 comprises a pair of spaced storage compartments 24, 26 interconnected by a bridge 28. Although the size of the storage compartments 24, 26 can vary, depending upon the size of the glucose tablets to be stored therein, standard glucose tablets currently marketed are on the order of about 0.53 inches in diameter. Preferably, the interior diameter of each storage pocket has a diameter that is between about 0.15 and 0.30 inches larger than the diameter of the glucose tablets to be stored therein to allow the tablets to readily "fall out" when the container is turned upside down with the cover portion "open". Otherwise, the tablets are maintained in a stable situation within the storage container 10 to avoid damage. Obviously, the dimensions are not critical to the instant inventive concepts and can be modified to accommodate the tablets to be placed therein.

The cover 14 includes a pair of complementary cover portions 30, 32 interconnected by a bridge 34. Integral hinges 36, 38 are formed on each side of the bridge 34 pivotally connecting the cover portion 30, 32 to the bridge 34 for movement between a first position shown in FIG. 2 in which the cover portions 30, 32 cover and seal the storage pockets 24, 26, respectively, and a second position (not shown) in which one or both of the cover portions are lifted about its respective hinge to provide access to the storage pockets in an obvious manner.

To provide an effective seal between the cover portion 30, 32 and the storage pockets 24, 26, the cover 14 may include a peripheral flange 40 which snappingly or frictionally engages about the periphery of the housing 12. Finger-engaging portions 42 may be provided on the cover portions 30, 32 to facilitate opening each of the cover portions, as desired.

In order to facilitate cleaning of the storage container 10, the cover 14 may be removable from the housing 12. To that end, means are provided to interengage the cover 14 with the housing 12 in the form of a pair of pins 44 formed on the inside of the bridge 34 of the cover 14 to be secured in a pair of openings 46 formed in the bridge 28 of the housing 12.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A glucose tablet storage container for containing circular glucose tablets, said glucose tablet storage container comprising a housing member, a cover member, and a tab extending from one end of said housing member for connecting said container to a key holder, said tab including an aperture for receipt of a key holder;

said housing member having two cylindrical sections, each of the two cylindrical sections including a circular open top, a closed bottom and a cylindrical wall extending between said top and said bottom to form a cavity sized to receive at least one circular glucose tablet;

said cylindrical sections being separated and joined by a housing bridge section carrying one part of an interlocking retaining connection, said one part including two apertures in said housing bridge section;

said cover member having two complimentary cover portions integrally hinged separately on either side of a rectangular cover bridge section, said cover bridge section being dimensioned to overly said housing bridge section;

said cover portions having peripheral wall flanges encircling and extending along said cylindrical sections of said housing member;

said wall flanges of said cover portions being dimensioned to frictionally engage with an outer periphery of said cylindrical walls of said housing member to individually releasably close the cavities of said housing member;

said cover bridge section having a second part of said interlocking retaining connection, said second part including two pins projecting from said bridge section of said cover, said two pins of said second part of said retaining connection engaging with said two apertures of said first part of said retaining connection carried by said bridge section of said housing member to attach said cover member to said housing member;

said housing bridge section and said cover bridge section having maximum dimensions less than a diameter of said cylindrical walls to provide an indented, wave shape to each side of said container corresponding to a share of two laterally spaced circular glucose tablets to be stored therein so as to minimize detrimental excessive movement of the to be stored circular glucose tablets in the housing member.

* * * * *